United States Patent [19]

Calderon

[11] 3,984,310

[45] Oct. 5, 1976

[54] APPARATUS AND METHOD FOR MINIMIZING ACCUMULATION OF DEPOSITS BETWEEN THE DOOR AND JAMB OF A COKE OVEN AND FOR HEATING THE ENDS OF THE COKE OVEN

[76] Inventor: Albert Calderon, 1065 Melrose Drive, Bowling Green, Ohio 43402

[22] Filed: Oct. 29, 1974

[21] Appl. No.: 518,887

[52] U.S. Cl. ..... 201/2; 202/133; 202/269; 202/270; 202/241; 202/242; 202/248; 110/173 R; 431/32; 134/20; 134/39; 49/475

[51] Int. Cl.[2] ..... C10B 43/12; C10B 43/10

[58] Field of Search ..... 202/133, 269, 270, 241, 202/242, 248; 110/173 R; 431/32; 122/498; 134/20, 39; 201/2; 432/242; 49/475

[56] References Cited

UNITED STATES PATENTS

| | | | |
|---|---|---|---|
| 1,056,270 | 3/1913 | Feicks | 202/248 |
| 1,961,933 | 6/1934 | Irwin | 431/32 |
| 2,855,347 | 10/1958 | Cellan-Jones | 110/173 R X |
| 3,158,320 | 11/1964 | Duncan | 431/32 X |
| 3,454,426 | 7/1969 | Taylor | 202/241 X |

*Primary Examiner*—James H. Tayman, Jr.

[57] ABSTRACT

An improved by-product coke oven wherein the ends are heated through the doors or jambs to prevent condensation of the tar and the deposit of carbon and coal. This improved coke oven possesses improved sealing features and minimizes pollution during coking and during the extraction of the doors.

14 Claims, 6 Drawing Figures

APPARATUS AND METHOD FOR MINIMIZING ACCUMULATION OF DEPOSITS BETWEEN THE DOOR AND JAMB OF A COKE OVEN AND FOR HEATING THE ENDS OF THE COKE OVEN

This invention relates to an improved by-product coke oven of the type commonly used for the commercial production of coke.

In the art of making coke in a by-product oven which is one of many ovens situated side by side in battery form, the coal is charged in slot-type chambers and is heated indirectly by means of heated refractory walls. During the baking or the "coking" cycle which lasts about 17 hours the oven is under positive pressure which causes the gases evolved from the coal to be forced to leave the oven by means of an ascension pipe. These gases are processed in the by-product coke plant which is connected to the battery. The battery of ovens has two sides; the pusher side and the coke side and each oven has two doors — one on the pusher side and one on the coke side. Each oven further possesses two jambs — one on the pusher side and one on the coke side and each of said doors seals against each of said jambs.

The heating of the refractory walls of the oven is done by flues which extend along the length of the oven and as close as practicable to each end of the oven. Since the flues extend to a certain distance from each door and jamb the area occupied by the door and the jamb are relatively cold compared to the inside of the oven. During coking, gases laden with tar condense against the inside of the door and the jamb and the refractory plug of the door extending into the oven gets partially covered with tar, carbon and coal generally in the half away from the inside of the oven.

It is known that a coke oven door can be sealed fairly well against the jamb face if a minimum of tar deposit exists and provided that there exists a good fit between the sealing edge of the door and the jamb face, and in order to make such a seal possible devices have been developed on pushers and on door extractors to clean the jamb and clean the door of tar, carbon and coal. These cleaners have not been successful because of:

i. their complexity
ii. door and jamb distortion
iii. carbon hardness, and
iv. stickiness of tar.

With the above factors in view the main object of this invention is to provide an improved coke oven which has features to keep the ends of said oven hot to prevent condensation of the tar and the deposits of carbon and coal.

Another object of this invention is to provide an improved coke oven which possesses features capable of burning the deposits of tar, carbon and coal.

Further another object of the instant invention is an improved coke oven capable of maintaining the inside of the door and the jamb clean to make it possible to seal properly.

Yet another object of this invention comprises the provision of an improved coke oven having protection on the metallic part of the jamb or door from excess heat in order to prevent thermal damage thereto.

It is still another object of this invention to minimize the green ends thereof by extending the heating capacity beyond the limited heating capabilities of the conventional end flues.

Further yet another object of this invention provides an improved coke oven which upon the door extraction, said door and jamb emit practically no smoke to make the working conditions more ameanable.

It is further yet another object of this invention to provide heating means mounted on the jamb of said oven with proper controls to effectively heat the cold ends of said oven.

Yet it is another object of the instant invention to provide an improved coke oven having the door thereof equipped with heating means with proper controls to heat the cold ends of said oven, the energy for heating being coke oven gas, blast furnace gas, a mixture of both or electric.

Other objects of this invention will appear from the following detailed description and appended claims.

Reference is made to the accompanying drawings forming a part of this specification wherein like reference characters designate corresponding parts on the various views.

Figures 1, 2, 3, 4, 5, 6:
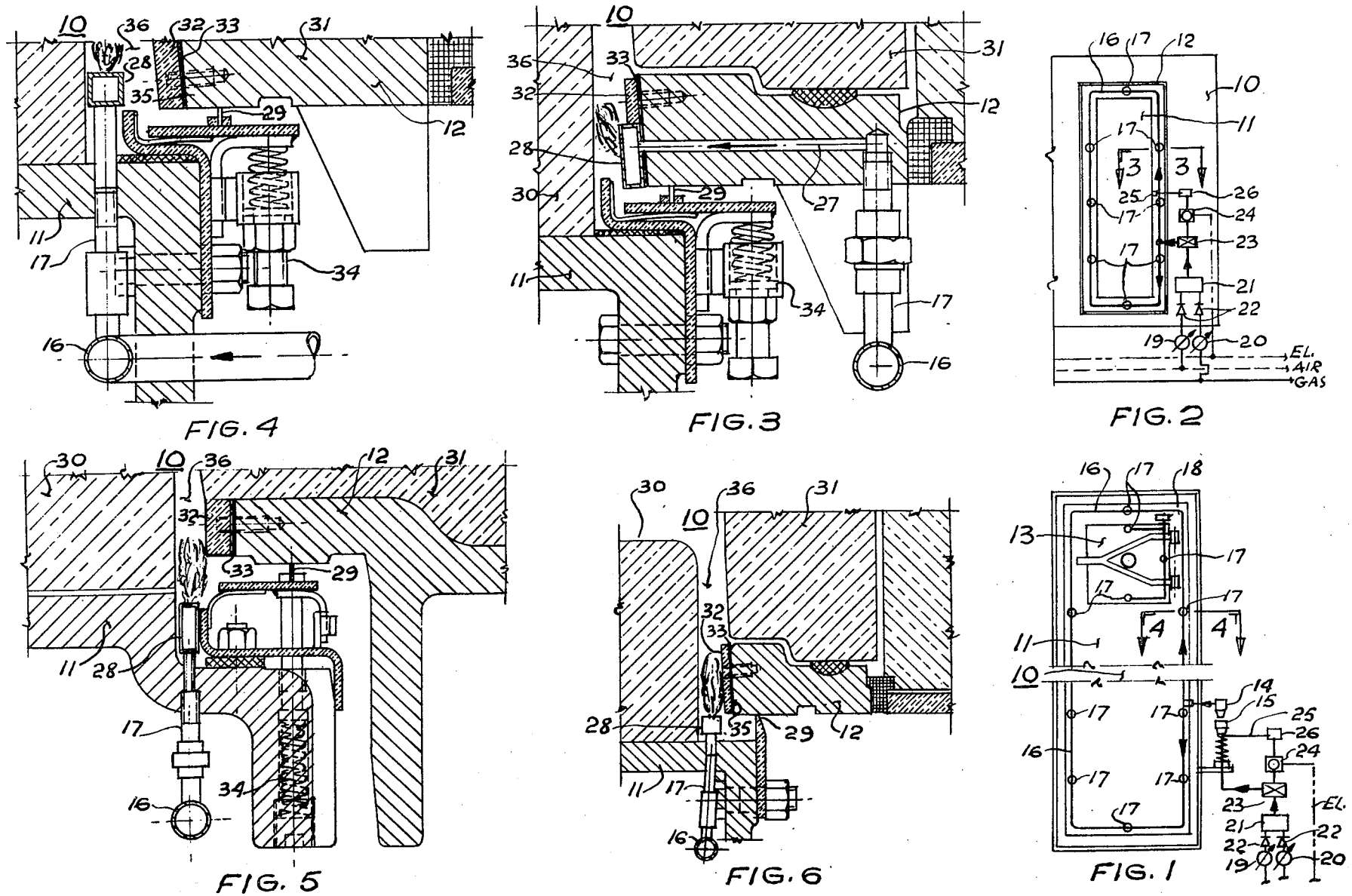
FIG. 1 is a representation of the door to cover the end of the improved oven on the pusher side. It shows the means for the feeding of the fuel through said door.
FIG. 2 shows an arrangement for the introduction of fuel into the jamb including controls represented diagramatically.
FIG. 3 is a section taken at 3—3 of FIG. 2 showing the introduction of fuel through the jamb.
FIG. 4 is a partial section taken at 4—4 of FIG. 1 showing the introduction of fuel through the door of the oven as applied to one design of door.
FIG. 5 is a partial section of the invention showing the introduction of the fuel through the door as applied to a second type of door design.
FIG. 6 is a partial section of the invention showing the introduction of the fuel through the door as applied to a third type of door design.

Before explaining in detail the present invention it is to be understood that the invention is not limited to its application and to the details of construction and arrangement of the parts illustrated in the accompanying drawings since the invention is capable of other embodiments. Also it is to be understood that the phraseology or terminology employed herein is for the purpose of description and not limitation.

DETAILED DESCRIPTION OF DRAWINGS

In FIG. 1 reference numeral 10 indicates the oven and 11 is the door to cover the end of oven 10. The jamb of oven 10 is represented by numeral 12. Door 11 possesses a leveling door 13 through which the coal is leveled. Lock valve 14 is provided to door 11 so that it makes connection with fuel outlet 15 which is attached to a suitable location of the oven such as mounting against a conventional buckstay.

Door 11 also possesses manifold 16 to distribute fuel and air to various entry points such as point 17 for the supply of fuel and air. Special connection 18 is provided to leveling door 13 in order to make a flexible connection between manifold 16 and leveling door 13. By way of example, regulator 19 is to control the air and regulator 20 is to control the fuel for feeding into mixer 21. Check valves 22 are provided to control into mixer 21. Valve 23 controls flow into outlet 15. Timer 24 initiated by actuator 25 through limit switch 26 controls the time cycle of the operation.

In FIG. 2 wherein the introduction of fuel is through jamb 12 manifold 16 is made part of the jamb and points of entry of fuel and air are provided to jamb 12. Regulators 19 and 20 feeding into mixer 21 and controlled by check valves 22 are also provided. Valve 23, timer 24 and actuator 25 which operates limit switch 26, are also used in this case similar to FIG. 1.

In FIG. 3, 10 represents the oven, 11 the door and 12 the jamb. Manifold 16 feeds air and gas through orifice 27 which directs the mixture to burner 28. Burner 28 takes preferably the shape of a ribbon burner in order to get maximum coverage. 29 and 30 are the sealing edge and the refractory plug respectively of door 11.

Numeral 31 represents the refractory of oven 10 and 32 is the heat shield of jamb 12. Insulator 33 in the form of fiber-frax or the like material is introduced between jamb 12 and heat shield 32 which shield is preferably made of high heat resistant as well as abrasion resistant metal. Numeral 34 indicates the adjustment of sealing edge 29 of door 11.

In FIG. 4 manifold 16 shows entry point 17 through door 11 with burner 28 being also in the form of a ribbon and carried by door 11. Heat shield 32 is shown to protect the complete oven face 35 of jamb 12. The arrangements shown by FIGS. 5 and 6 are examples of oven 10 as applied to different door designs.

While the operation of the improved coke oven may be comprehended from a study of the foregoing description it is believed that the operation may be further explained as hereinafter set forth.

OPERATION

Referring to FIG. 1, Door 11 is set in place against jamb 12 by means of the door extractor (not shown and not part of this invention). Upon securing door 11 to oven 10, lock valve 14 nests inside outlet 15 at which time actuator 25 is operated to initiate timer 24 by means of switch 26. Timer 24 operates valve 23 and feeds a mixture of air and gas into manifold 16 and thence through entry point 17 into burner 28. It is contemplated to feed gas only under substantial pressure at the beginning until ignition takes place, then air is fed to mix with the fuel and the flame cut down so that a proper flame height is maintained in gap 36 where the accumulation of tar, carbon and coke takes place. It is preferred to initiate the burning before charging occurs, in order to prevent the condensation of the tar by pre-heating the area of deposit. After lapse of the period of tar gas formation in the oven, burner 28 may be turned off except for some fuel input through its orifices so that the orifices of burner 28 remain open.

In providing conditions in area 36 condusive to the prevention of condensation of tar gases by heating and by the virtue that burner 28 is capable of burning any deposits, the cold area now prevailing at the ends of the oven is converted to such an environment which prevents the problem before it occurs and if it does occur the conditions are such that any tar, carbon or coal deposits are burned by the flame. The fact that the oven is hot beyond the jamb within the oven ignition of the gas is made possible. While the drawings have shown the invention using gas for heating the cold ends of oven 10 since the availability of coke oven gas is prevalent in a coke plant, it does not mean that other means of heating may not be used. While the invention has been described in detail following a certain mode of operation it is not intended to limit the invention to the exact description but claim all variations falling within the purview of the appended claims.

I claim:

1. In a coke oven of the type having a chamber with an opening, removable closure means for closing the opening and including sealing means for engaging a portion of the jamb surrounding the periphery of the opening so that the closure means and the sealing means substantially seal the opening and primary heating means for heating said chamber for coking coal within said chamber, the improvement comprising secondary heating means including means for directing at least a portion of a combustible mixture from a location externally of the seal formed by the closure means and the sealing means to a location internally of the seal and adjacent a selected portion of the periphery of the opening for heating said selected portion of the periphery of the opening which is internal of the seal when the opening is closed by said removable closure means and the sealing means and while the chamber is being heated by the primary heating means.

2. In a coke oven of the type set forth by claim 1 wherein said secondary heating means comprises means forming an ignited burner flame at said selected portion of the periphery of the opening which are disposed inwardly of the seal.

3. In a coke oven as set forth by claim 1 wherein each of said means for directing at least a portion of a combustible fluid comprises fluid passage means carried by said closure means and disposed so that when said closure means is in its closed position the outlet portion of said fluid passage means is substantially adjacent a selected portion of the periphery of the opening.

4. In a coke oven as set forth by claim 1 wherein each of said means for directing at least a portion of a combustible fluid comprises a plurality of fluid passage means formed in a portion of the jamb of the coke oven.

5. In a coke oven as set forth in claim 1 and further including a source of said fluid forming at least part of a combustible mixture disposed at a location externally of the seal, control means for controlling the directing of said fluid from the source to a location adjacent said selected portion of the periphery of the opening at selected periods during the coking cycle.

6. In a coke oven as set forth by claim 5 wherein said control means comprises a timer means, and means for actuating said timer means upon the closing of said closure means.

7. In a coke oven as set forth by claim 6 wherein said timer means is operative to initiate conducting of said fluid to said location adjacent the selected portion of the periphery of the opening prior to the charging of the coke oven.

8. In a coke oven of the type set forth by claim 1 wherein said secondary heating means are effective so as to provide an ignited burner flame disposed in the area between the jamb of the opening and the closure means, and heat shield means being disposed between the burner flame and the jamb.

9. In a coke oven of the type set forth by claim 1 wherein the coke oven is further of the type in which the chamber includes two openings, one on the pusher side of the oven and one on the coke side of the oven, secondary heating means of the type set forth by claim 1 being adapted to heat a selected portion of each of the openings adjacent the periphery of the openings when the openings are closed by the respective removable closure means.

10. In a coke oven door of the type in which a primary heating system serves to heat the oven for coking coal within the oven and having a sealing surface which engages the jamb of an opening in a coke oven chamber so that the door and the sealing surface are effective to substantially seal the opening, the improvement comprising a secondary heating system comprising one or more fluid conduits extending through the door, each of said fluid conduits having an inlet portion and an outlet portion, each of said fluid conduits being disposed such that when the sealing surface engages the jamb of the oven the outlet portion of each conduit is disposed inward of the seal formed by the door and the sealing means adjacent the periphery of said opening, and means for directing a fluid forming at least part of a combustible mixture to the inlet portion of each conduit.

11. Apparatus comprising a coke oven door of the type in which a primary heating system serves to heat the oven for coking coal within the oven and having a sealing surface for engaging the jamb of an opening in a coke oven chamber so that the door and the sealing surface are effective to substantially seal the opening, secondary heating means comprising one or more fluid conduits extending through the door, each of said fluid conduits having an inlet portion and an outlet portion, each of said fluid conduits being disposed such that when the sealing surface engages the jamb of the oven the outlet portion of each conduit is disposed inwardly of the seal formed by the door and the sealing means and substantially adjacent a selected portion of the periphery of said opening, and means for directing a fluid forming at least part of a combustible mixture to the outlet portion of each conduit.

12. In a coke oven jamb of the type which generally surrounds an opening in a coke oven chamber, which opening is conventionally closed by a coke oven door having a sealing surface which engages a surface of the jamb so that the door and the sealing surface are effective to substantially seal the opening, the coke oven including primary heating means for coking coal within the chamber, the improvement comprising secondary heating means comprising one or more fluid conduits formed in the jamb, each fluid conduit having an inlet portion and an outlet portion, each fluid conduit disposed such that when the door closes the jamb the outlet portion of each conduit lies inwardly of the seal formed by the door and the sealing surface and substantially adjacent a selected portion of the periphery of said opening, and means for directing a source of fluid forming at least part of a combustible mixture to the inlet portion of each conduit.

13. A method of heating the area adjacent the opening formed in a coke oven chamber when the opening is closed by a closure and a sealing means carried by the closure, and wherein the oven includes primary heating means to coke coal disposed within the oven, comprising the steps of securing a coke oven door in sealing relationship with a jamb surrounding the opening and directing at least a portion of a combustible mixture from a location outward of the seal formed by the closure and the sealing means to selected locations disposed inward of the seal and adjacent to selected portions of the periphery of the opening.

14. A method as set forth in claim 13 including the step of automatically feeding the combustible mixture to the area between the door and the jamb upon the securing of the door of the jamb.

* * * * *